US007175548B2

(12) United States Patent
McNulty

(10) Patent No.: US 7,175,548 B2
(45) Date of Patent: Feb. 13, 2007

(54) UNIVERSAL, POSITION-ADJUSTABLE BACKSTOP NET SYSTEM

(76) Inventor: John M. McNulty, 215 Duke Dr., Sequim, WA (US) 98382

( * ) Notice: Subject to any disclaimer, the term of this patent is extended or adjusted under 35 U.S.C. 154(b) by 0 days.

(21) Appl. No.: 11/208,341

(22) Filed: Aug. 19, 2005

(65) Prior Publication Data

US 2006/0040769 A1 Feb. 23, 2006

Related U.S. Application Data

(60) Provisional application No. 60/603,108, filed on Aug. 20, 2004.

(51) Int. Cl.
*A63B 69/00* (2006.01)

(52) U.S. Cl. ..... 473/431; 473/421

(58) Field of Classification Search ..... 473/484, 473/431, 433, 432, 447, 416, 473, 460, 158, 473/434, 435, 421; 248/165; 40/603; 116/173
See application file for complete search history.

(56) References Cited

U.S. PATENT DOCUMENTS

| | | | | | |
|---|---|---|---|---|---|
| 1,166,496 | A | * | 1/1916 | Crum | 473/173 |
| 1,575,040 | A | * | 3/1926 | Crum | 116/173 |
| 1,765,269 | A | | 6/1930 | Hatley | |
| 2,882,630 | A | * | 4/1959 | Frey | 40/604 |
| 3,195,898 | A | | 7/1965 | Respini | |
| 3,227,449 | A | | 1/1966 | Schwab | |
| 3,286,682 | A | * | 11/1966 | Cook et al. | 116/173 |
| 3,776,550 | A | | 12/1973 | McNabb | |
| 3,901,506 | A | | 8/1975 | Caveney | |
| 3,986,719 | A | | 10/1976 | Lee | |
| 4,063,739 | A | | 12/1977 | La Rose | |
| 4,095,360 | A | * | 6/1978 | Dinan et al. | 40/603 |
| 4,153,246 | A | | 5/1979 | Byrne | |
| 4,291,885 | A | | 9/1981 | Cohen | |
| 4,693,472 | A | | 9/1987 | Newman et al. | |
| 4,762,319 | A | | 8/1988 | Krumholz | |
| 4,786,371 | A | | 11/1988 | Postol | |
| 4,880,239 | A | | 11/1989 | Leneveu | |
| 4,979,754 | A | | 12/1990 | Eisenhart | |
| 5,007,645 | A | | 4/1991 | Weigl et al. | |
| 5,016,875 | A | | 5/1991 | Joseph | |
| 5,116,056 | A | | 5/1992 | Schmutte | |
| 5,129,648 | A | | 7/1992 | Sweeney et al. | |
| 5,183,253 | A | | 2/1993 | Grimaldi et al. | |
| 5,312,099 | A | | 5/1994 | Oliver, Sr. | |

(Continued)

*Primary Examiner*—Eugene Kim
*Assistant Examiner*—M. Chambers
(74) *Attorney, Agent, or Firm*—Innovation Law Group, Ltd.; Jacques M. Dulin, Esq.

(57) ABSTRACT

A multiple sports, universally positionable, adjustable net-type backstop system mounted to a pole, such as a basketball hoop pole, comprising an outrigger assembly that is vertically and horizontally adjustable and rotatable 360° on a vertical axis, so that the net can be selectively positioned in front, behind or to either side of a basketball backboard. The outrigger assembly is mounted on the support pole via a horizontally pivotable bracket assembly which permits a net assembly retainer bracket to be pivoted down to a convenient height, such as from chest height down to as low as ground level, for ease and safety in mounting and removing the net assembly. The vertical and horizontal adjustability, 360° rotation, and pivoting functionalities are very important safety features, in that the user need not use a tall step ladder to mount and adjust the position of the net, or remove it for storage.

16 Claims, 10 Drawing Sheets

U.S. PATENT DOCUMENTS 5,374,054 A 12/1994 Suess
5,402,999 A 4/1995 Keehn, Sr.
5,615,889 A 4/1997 Long
5,785,616 A 7/1998 Dodge
5,971,873 A 10/1999 Balducci
6,074,313 A * 6/2000 Pearson ..... 473/433
6,192,611 B1 * 2/2001 Molla ..... 40/604
6,422,957 B1 * 7/2002 Winter et al. ..... 473/484
6,530,338 B2 * 3/2003 Okumura et al. ..... 116/173
6,595,877 B2 7/2003 Pearson

* cited by examiner

UNIVERSAL, POSITION-ADJUSTABLE BACKSTOP NET SYSTEM

CROSS REFERENCE TO RELATED APPLICATIONS

This is the Regular U.S. Patent Application of prior Provisional Application Ser. No. 60/603,108 filed Aug. 20, 2004 by the same inventor under the same title, the priority of which is claimed under 35 US Code, Sections 119, 120, ff, and the disclosure of which is hereby incorporated by reference.

FIELD

The invention relates to multi-sports and exercise backstop systems, and more particularly to pole-mounted net-type backstops that are removably suspended from a bracket bar that is universally positionable and vertically adjustable. The inventive backstop net assembly may be mounted to a basketball pole and positioned behind the backboard, or rotated to one or the other sides, to provide a backstop for missed or practice shots. The netting may be rotated to the back, front or one side to serve as a golf chipping and driving, tennis, soccer, badminton, hockey, baseball, or the like ball-sport backstop. The unit is light, easily assembled and installed, and can be provided in short segments parts kit form for ease of shipping and storage. The netting is suspended from an outrigger assembly that includes a pivot to permit lowering the net suspension bracket bar for mounting or removal of the netting from ground level, an important safety feature as it means use of ladders is not required to mount, move or remove the net for storage.

BACKGROUND

Basketball return assemblies mounted to a basketball hoop support are known in prior art. For example, the basketball return assembly described in Pearson U.S. Pat. No. 6,074,313 (2000) comprises a tapered, directionally curved net fixedly mounted to a hoop support behind a basketball hoop. The Pearson device is configured to return a missed shot out to the court, and has a flexible, foldable return net. A similar design is described in a second Pearson U.S. Pat. No. 6,595,877 (2003) having an addition of an attachment bracket connected to opposite lower corners of the net so as to adjust the angle of the net for better direction return of the ball.

There are several disadvantages and limitations with these designs. A major disadvantage is that they are meant to be used only for basketball shot practice, but not other sports. Another disadvantage is that the net assemblies are restricted to positions behind and below the basketball hoop and backboard. This leads to several limitations. For example, the return net assemblies can only be properly utilized for practicing straight-on shots, such as free-throws, since any errant side or angled shots at the basketball hoop will not be caught or returned by a front-only facing net positioned behind the backboard. In addition, existing return net assemblies will not catch errant basketball shots hitting or being deflected anywhere above the basketball hoop or backboard. High errant shots will not be caught in the net and may cause damage to nearby garage doors, structures, windows, etc.

Accordingly, there is an unmet need in the art for a lightweight net hanger assembly that is universal, that is, can be positioned to the sides and front of a hoop and is useful for a wide variety of sports.

THE INVENTION

SUMMARY, INCLUDING OBJECTS AND ADVANTAGES

The invention comprises a universal, adjustable net-type backstop system mounted to a pole, such as a basketball hoop pole, comprising an outrigger assembly that is both vertically adjustable and rotatable 360° on a vertical axis, so that the net can be selectively positioned in front, behind or to either side of a basketball backboard. The outrigger assembly is mounted on the support pole via a horizontally pivotable bracket assembly which permits a net assembly retainer bracket to be pivoted down to a convenient height, such as from chest height down to as low as ground level, for ease and safety in mounting and removing the net assembly. The vertical adjustability, 360° rotation, and pivoting functionalities are very important safety features, in that the user need not use a tall step ladder to mount, deploy, remove or adjust the position of the net. Since the top of the net can be on the order of from about 12' to 14' above ground level, undertaking to lift a net to that height to secure it to a hanger, or to move its orientation (front, back, sides) could be difficult, if not dangerous, from even a 10' step ladder. Thus, the inventive backstop assembly is not only universal as to its positioning for a wide range of ball sports, but it is easy to install and mount/remove the net assembly from ground level, an important safety feature.

The outrigger assembly includes an elevator tubing sub-assembly comprising an outer sleeve-type tube in which is mounted a rotationally-positionable and vertically-adjustable inner tube or pole. A horizontal, telescoping extension arm assembly is mounted at one end to the top of the inner tube. The outer end of the extension arm supports an orthogonally-oriented horizontal U-bracket bar and net assembly. Typically, the net is on the order of 10–14' or more wide and is suspended vertically from a hanger rod that is received by U-brackets of the horizontal U-bracket bar. The net assembly may be extended or narrowed in width, as needed. Optionally, the base of the net can include, if needed, weights to maintain the position of the bottom of the net and to deaden the impact of the balls as they hit the netting. The horizontally pivotable bracket assembly permits pivoting of the elevator tubes around a horizontal axis to lower the U-bracket bar for mounting and removal from ground level of the hanger bar and net assembly for storage.

The outrigger assembly's horizontal extension arm assembly may be fixed in length, say on the order of 2' to 4' in length, but it is preferred to be adjustable in length by means of a telescoping tubing arrangement that permits the netting to be extended a distance well behind, in front of, or to the side of, the basketball backboard. The resulting clearance keeps the net barrier from becoming entangled with the basketball hoop or backboard. The clearance also provides space between the net barrier and the basketball pole itself, thereby providing a greater movement of the net in response to the force of balls striking the netting, cushioning or preventing impact of the ball against the hard surface of the basketball pole.

The three-dimensional (tri-axial: vertical, rotational and horizontal) adjustable nature of the net backstop system allows a user to deploy it in a multitude of positions in relation to the pole and/or basketball backboard, including: behind and below the backboard; behind and above the backboard; in front and below the backboard; in front and above the backboard; to the left side and below the backboard; to the left side and above the backboard; to the right side and below the backboard; and, to the right side and above the backboard.

As a result, the inventive backstop net system is universal. That is, it may be used for a wide variety of sports and sport practice because of the vertical and horizontal adjustability, the 360° rotation (side to side, front and back), and the selection of width, being on the order of 10–14' or more wide. For example, when the inventive backstop net is positioned to the rear of an existing basketball hoop, it acts as a large backstop above and/or below the backboard to stop errant basketball shots made from a position facing the basketball hoop (e.g., free throws). When the inventive backstop is rotated at substantial angles to the right or left of center, the net can be used as a backstop for the impact of basketball shots made from the opposite side or at wide angles to the backboard.

Accordingly, the inventive universal backstop system comprises a combination of three main sub-assemblies: 1) a mounting support assembly comprising a pair of vertically spaced pole brackets, one of which (preferably the upper) includes a horizontal pivot, and the other (preferably the lower one) is an alignment stop, and one end of each bracket is securable to a supporting pole, and the outer end of the brackets support an outrigger assembly; 2) an outrigger assembly comprising: a) an elevator tubing sub-assembly comprising a pair of coaxial, nested tubes (one inside the other) which are retained by the bracket assembly; b) a first, inner end of a telescoping, horizontal extension arm assembly attached to the top of the inner tubing of the elevator tubing assembly, c) a U-bracket hanger assembly attached to the outer end of the extension arm assembly; and 3) a netting assembly comprising a laterally extendable hanger rod from which a net is suspended and including optional net base tie-downs or weightable bags, functioning as a backstop.

The inventive backstop system net may also be used for practice in other sports, including, without limitation, tennis, golf, soccer and baseball. The inventive backstop net assembly keeps sport balls in proximity to the players and reduces the chances of damage to near-by structures, run-away balls, balls escaping over embankments, onto streets, into neighbors' yards, and so on.

When not in use, the inventive backstop net system does not interfere with normal use of the basketball hoop and backboard. The outrigger assembly remains mounted to one side of the basketball pole in a position that does not interfere with normal play. The net assembly can be easily removed as a single unit, rolled up on its mounting rod (hanger rod), and stored for later use. The pivoting bracket connecting the mounting pole to the elevator tubing assembly is preferably counterbalanced with a return spring to assist in raising the elevator assembly up from the horizontal back to the vertical use position.

The entire inventive ball backstop assembly can be easily mounted to and dismounted from a square or round pole. The elevator assembly, outrigger assembly and netting all can be provided in short segments so that the entire backstop assembly can be packaged in boxes of 4' lengths for ease of standard carrier shipping, such as by UPS, Fed-X Ground, or the like.

BRIEF DESCRIPTION OF DRAWINGS

The invention is described in detail by reference to the drawings, in which:

FIG. 3 is a connected set of elevation and exploded views of the vertical elevator assembly that is provided in segments for ease of shipping, in which FIG. 3A shows the assembled elevator sub-assembly, FIG. 3B shows the outer tube in two parts, FIG. 3C shows the inner tube, also in two parts, FIG. 3D is an exploded, enlarged view showing the upper end cap and washer, FIG. 3E is an exploded, enlarged view showing the threaded connector for the outer tube, FIG. 3F shows the bottom cap with inner tube bushing and lock nuts, and FIG. 3G shows the connector for joining the two parts of the inner elevator tube;

FIG. 4 is a set of three isometric views of the support clamp assembly, in which

DETAILED DESCRIPTION, INCLUDING THE BEST MODE OF CARRYING OUT THE INVENTION

Figure 1A:
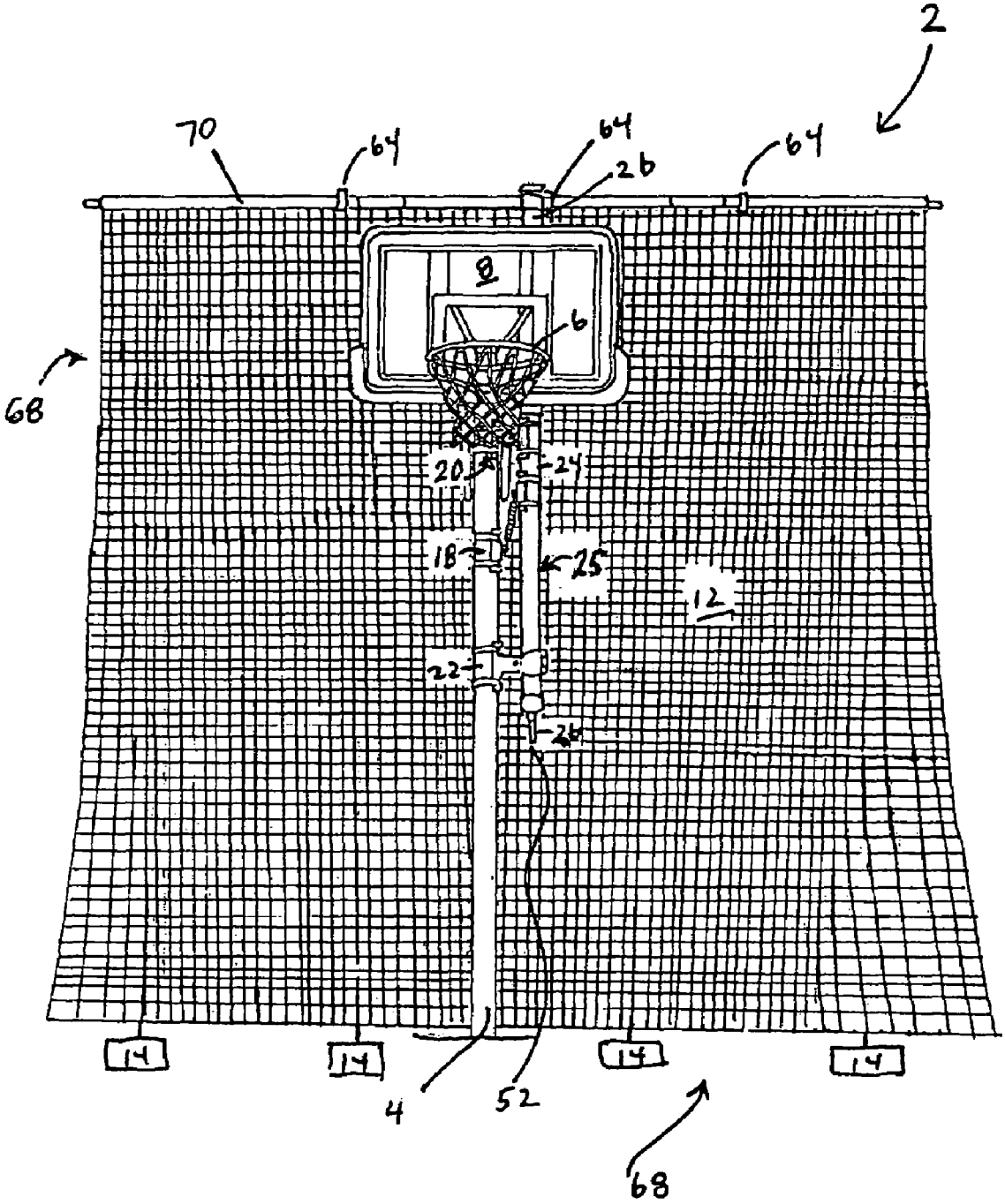
FIG. 1A is a front elevation view showing the inventive backstop net system mounted to a conventional basketball pole, with netting suspended behind and above the basketball backboard.

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

The Figures are numbered and annotated so that one skilled in the art of netted backstop assembly use and construction, by reference to the attached parts list, will easily be able to understand the materials and method of construction and will be able to easily assemble the parts to achieve the functionality shown.

FIGS. 1A–1D are a series of illustrations of the inventive backstop net system as mounted on a conventional basketball pole 4 having a backboard 8 and hoop 6. The inventive net assembly 68 shown in these figures comprises netting 12 adjusted to be behind and above the basketball backboard 8 in FIGS. 1A and 1C, to the side in FIG. 1B and in front FIG. 1D.

Figure 4A:
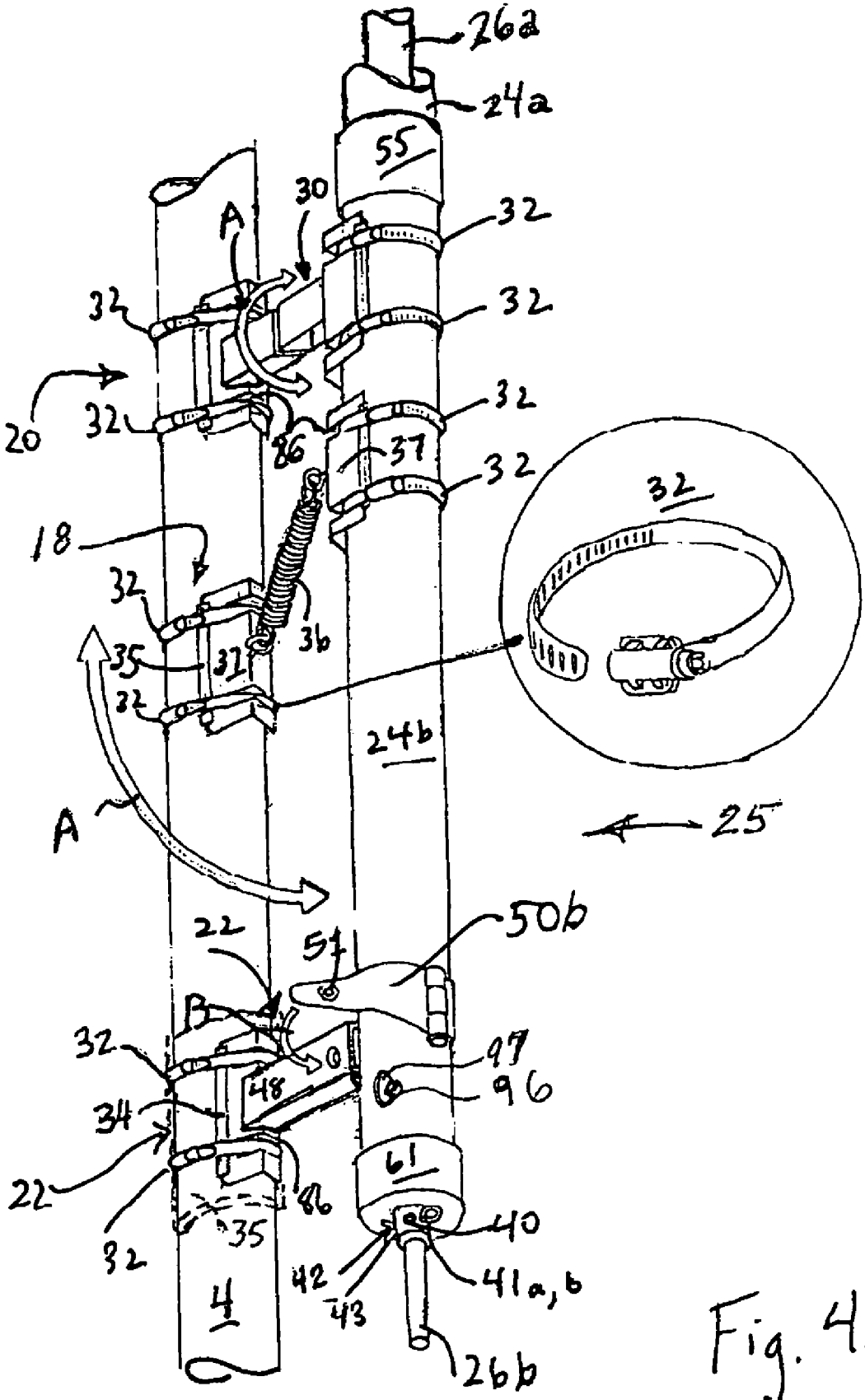
FIG. 4A is an isometric view from the front and slightly below showing the upper and lower bracket assemblies and the optional counter-balance spring and a close-up view of a clamp.

The net 12 is suspended in place by means of an outrigger assembly 10 mounted to the basketball pole 4 by mounting brackets 20, 22 and a counterbalance 18. Note, for clarity, the optional counterbalance assembly 18 is not shown in FIGS. 1B–1D and 2; rather, it is best seen in FIGS. 1A, 2B and 4A. The top of outrigger assembly 10 supports a horizontal extension assembly 54 comprising a U-bracket bar 64 at the outer end of a telescoping extension 60. The U-bracket bar assembly 64 in turn supports the net assembly 68 that is hung from a net hanger bar or thin wall pipe 70. Weights 14, such as sand or water filled bags tied to the base of the netting, help deaden the force of the balls impacting the netting 12 by providing tension on the netting, thereby increasing the effectiveness of the backstop.

Figure 1C:
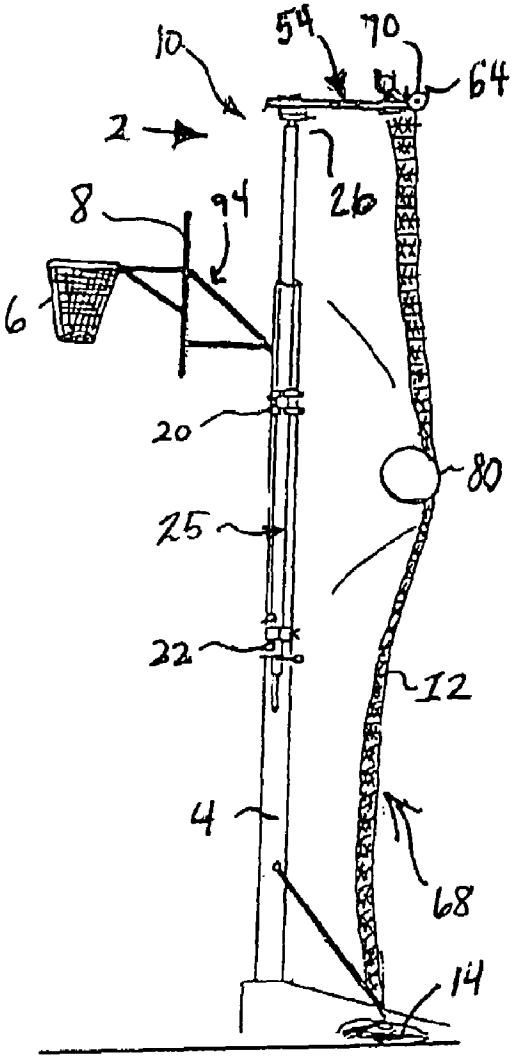
FIGS. 1B–1D are front and side elevations, respectively, showing multiple uses of the inventive backstop net system, including use for golf ball hitting, basketball and baseball practice.
Figure 1B:
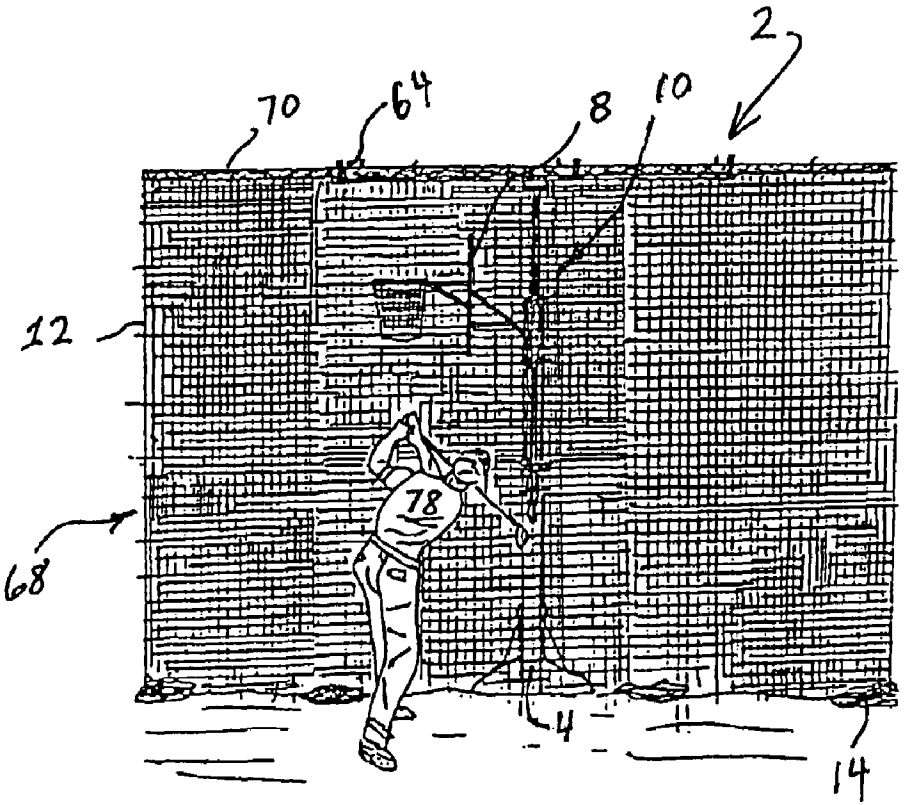
Figure 1D:
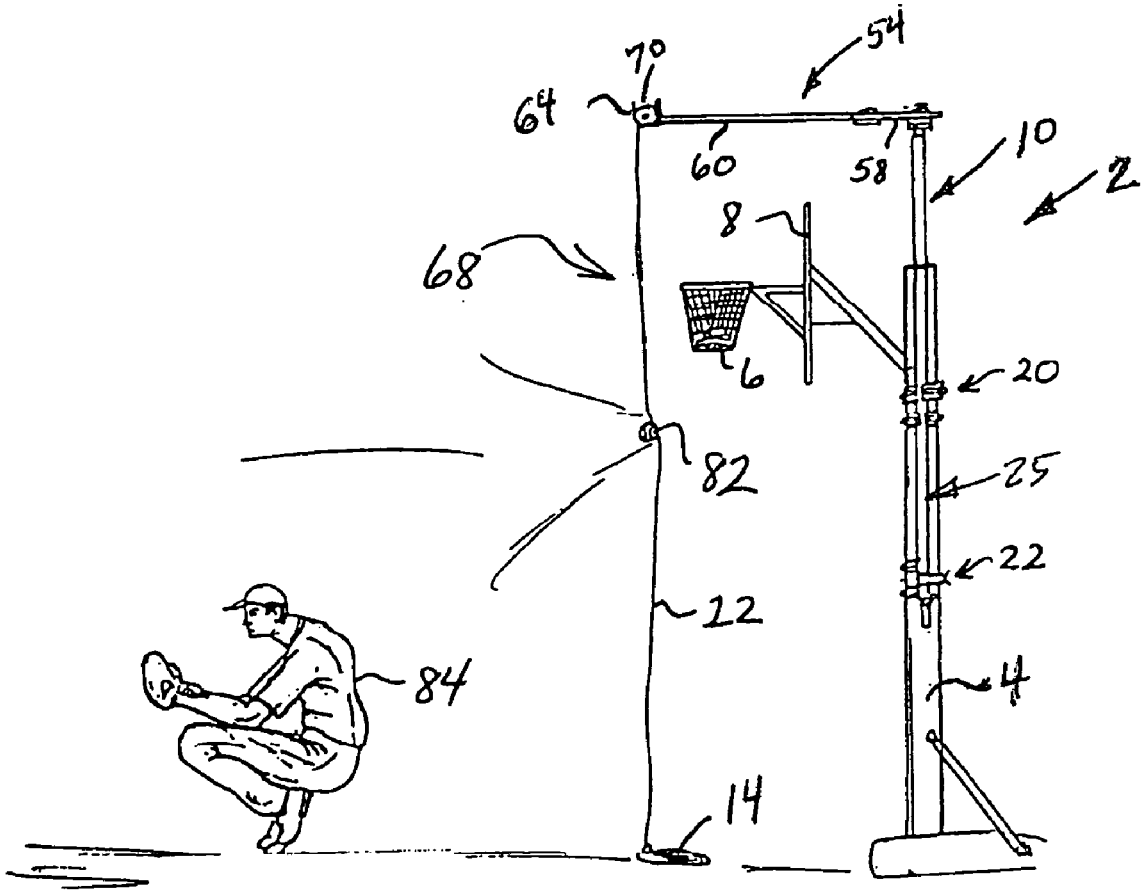

FIGS. 1B–1D are front and side elevations showing multiple uses of the inventive backstop net system 2 for various sports and sport practice, including, without limitation, use in golf ball hitting practice (FIG. 1B), basketball shot practice (FIG. 1C), and baseball (FIG. 1D). FIG. 1B shows the net assembly 68 positioned to the side and above the basketball backboard 8. Note that net assembly 68 of FIG. 1B is wider than the net assembly 68 shown in FIG. 1A to accommodate errant golf ball hits by a person practicing golf shots 78. FIG. 1C shows the net assembly 68 suspended behind and above the basketball backboard 8 for catching errant basketball shots 80. FIG. 1D shows the net assembly 68 suspended in front of and above the basketball backboard 8 for use as a backstop to errant baseballs 82 not caught by a baseball catcher 84. Uses of the inventive backstop net system 2 include, without limitation, golf, tennis, baseball, cricket, basketball, football, street and ice hockey, soccer and lacrosse.

Figure 2A:
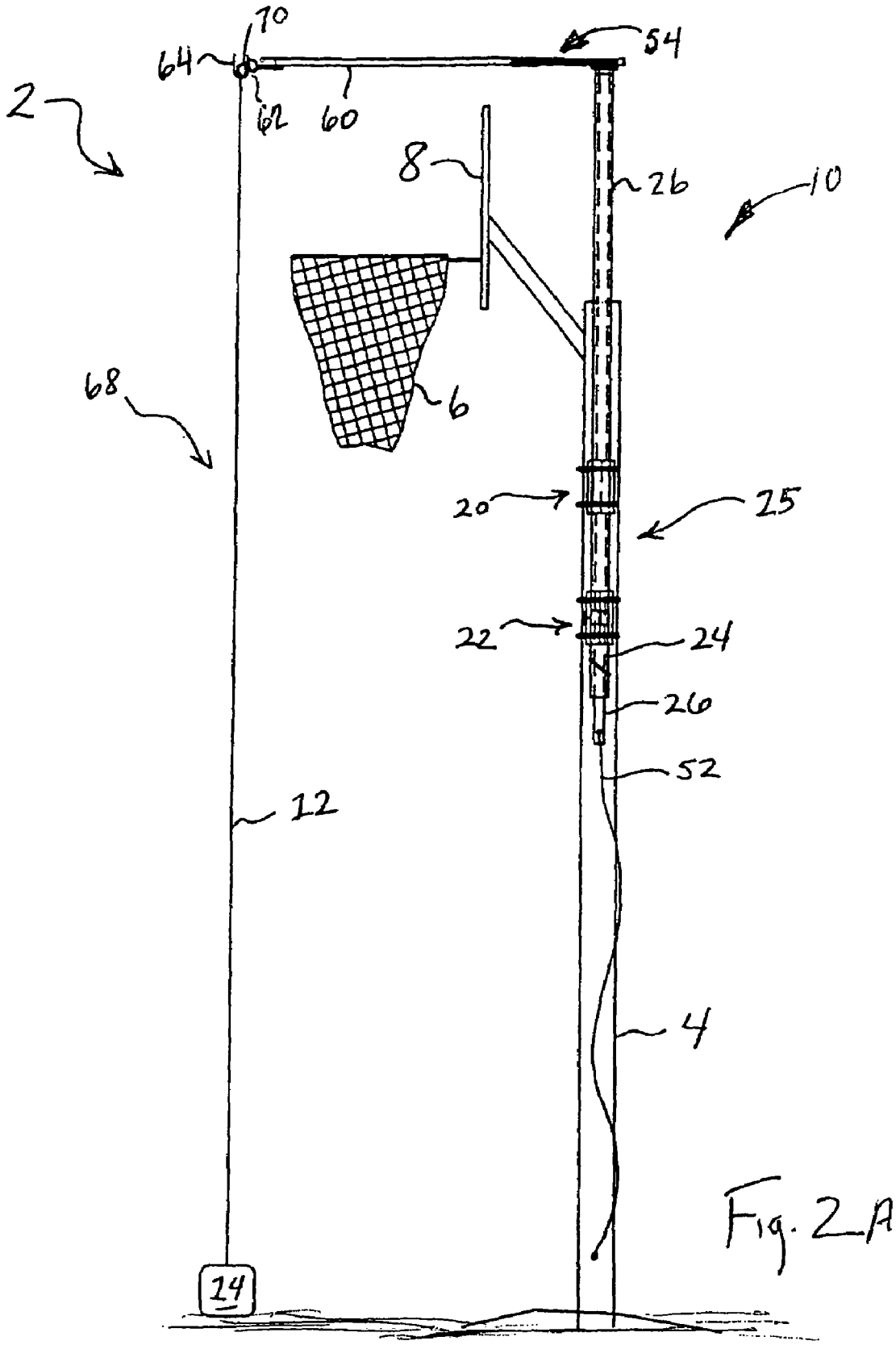
FIG. 2A is a side elevation view showing the inventive backstop system mounted in a vertical use position to a basketball pole with the net oriented to be suspended above and in front of the basketball backboard.
Figure 2B:
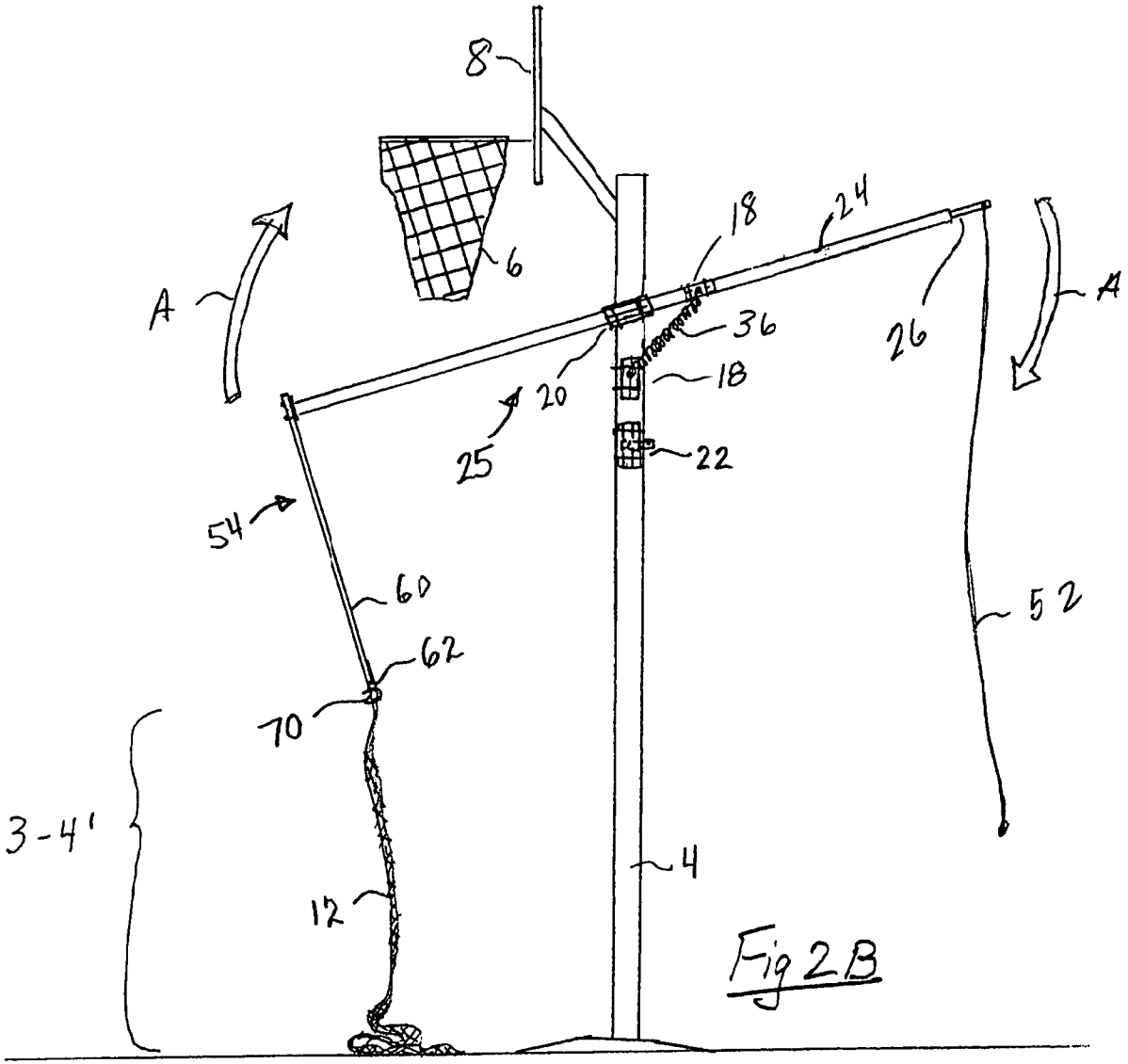
FIG. 2B is a side elevation view of the inventive backstop system showing the outrigger, the extension arm and the U-bracket bar rotated down to approximately waist high to facilitate mounting and removing the netting assembly (the hanger rod plus net secured thereto)

FIG. 2A is an enlarged side elevation view of the net assembly 68 suspended by outrigger assembly 10 above and in front of the basketball backboard 8. While shown mounted to a basketball pole 4, it should be understood that the inventive backstop system 2 can be mounted on any round, square, octagonal or other shape pole or post without a basketball backboard/hoop assembly. The outrigger assembly 10 comprises a vertical elevator assembly 25 mounted to a pole 4 by the upper and lower bracket assemblies 20, 22 (and counterbalance 18, not shown in this figure). The vertical elevator assembly 25 comprises an outer tube 24 and an inner, adjustable elevator tube or pole 26. Adjustable elevator pole 26 is held in angular position within the outer tube 24 by pin 42 (best seen in FIG. 4A) inserted in the corresponding hole 40 (FIGS. 3A, 3B, 3F and 4A) in the adjustable elevator pole 26 and outer tube 24. Optionally, a user may extend the height of the vertical elevator assembly 25 by sliding the elevator tube 26 outward when in the horizontal orientation, or upward when in the vertical orientation, in tube 24 and securing it with pin 97 inserted through hole 96 in the outer tube 24 and selected one of holes 98 in the inner elevator tube 26. Thus the height of the netting can be adjusted from below the height of the basketball backboard or hoop (as a reference point), to above it.

It is an important feature of the invention that the elevator assembly 25 includes a tube within a tube. This permits rotation of the inner elevator tube 26 a full 360°, so that the entire net assembly 68 can be rotated to be hung in front, in back or to one or the other side of the pole, as shown in FIGS. 1A–1D and 2. This rotational feature of the inner tube of the elevator assembly permits precise location of the net where it is best suited for a given ball practice with respect to a given site. In addition, as the inner elevator tube 26 projects below the fixed (non-rotating) outer tube 24, it can be easily grasped from ground level. That is, to rotate the net to a new angular orientation, the user need not have a step-ladder. Rather, the user simply rotates the pole 26, which in turn rotates the horizontal extension assembly 54 and the net 12 on its hanger rod 70. The difficulties and dangers of using a ladder are eliminated by the safer and easier to use functionalities of the inventive backstop system.

Figure 4B:
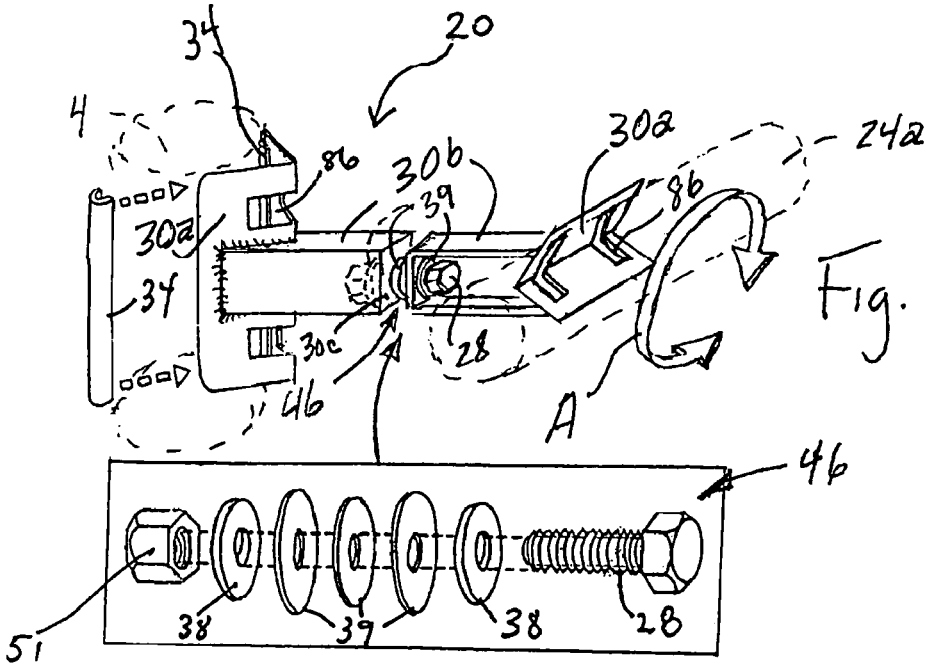
FIG. 4B shows the pivotable upper clamp with an enlarged exploded view of the pivot bolt.

As best seen in FIG. 2B, it is another very important feature of the invention that the user need not use a ladder to mount or remove the netting 12 and its hanger bar 70 in the U-brackets 64 of the U-bracket bar on the outer end of the horizontal extension 60. This is the purpose of the pivot function of the upper bracket 20. As seen in FIG. 2B, the lower bracket 22 is unclamped (see FIG. 4A and 4C), and the outrigger assembly 25 is now free to pivot. The user, by pushing up on the lower end of the elevator assembly 10 causes the extension arm assembly 54 to move downwardly, carrying with it the U-bracket bar 62. Arrows A in FIGS. 2B, 4A and 4B show the rotation of half of the bracket 20 (and the tubes 24, 26 of elevator assembly 25) around the horizontal pivot 46 after the clamp of bracket 22 is released, as shown by Arrow B in FIGS. 4A and 4C.

When the U-bracket bar is lowered to within convenient reach, say waist high or even lower, the net assembly 68 is mounted in the brackets 64 of the U-bracket bar 62. The top of the net 12 has previously been secured to the net hanger bar 70 by ties 72 (see FIG. 6). At that point, the net can be raised to full height. Note that rope 52 is tied through a hole in the lower end of the vertically adjustable elevator tube 26 (or it may be secured to the lower end of the outer tube 24) so that when the elevator assembly 10 has been tilted horizontally around the pivot of bracket 20, pulling down on the rope 52 assists in bringing the outrigger assembly back to its original, upright vertical position parallel to the basketball pole 4, that is, back to the position of FIG. 2A with the net 12 vertical. It is an important optional feature to provide the spring-biased counter balance assembly 18 to assist in raising the weight of the net assembly 68. The extension spring 36 can be chosen to have a return force such that when the outrigger assembly is essentially horizontal, it is balanced, that is neutral buoyancy. Thus, small downward force on the rope 52 causes the outrigger to rise to the vertical. The combination of the rotational capability of the inner elevator pole 26, the bracket pivot 46 and the counterbalance 18 provide an extremely universal, safe, and easy to use backstop assembly, features not heretofore found in the art.

It should be understood that the upper pivot bracket 20 is mounted at about the 8' level above the ground so that the top of the net assembly hanger bar 70 is at the 13'–15' height where netting is desired to extend above the basketball backboard. The corresponding securement point of the elevator half of bracket 20 should be at about the mid-point of the outer elevator tube 24. A normal 6'–8' step ladder can be used to mount the bracket 20 to the pole and to clamp the elevator assembly to that clamp. Thereafter the operations of mounting the counter-balance 18, the lower bracket 22, the net assembly 68 and for adjustment and removal of the net, can be done from ground level. In single piece form, the elevator assembly outer tube is on the order of 7' to 7' 6" in length and the inner tube about 6" to 1' longer. In divided sections form for 4' box shipping, the lengths of each are about 6" longer due to the addition of connector sections.

It should be understood that FIG. 2B is an idealized depiction. In actual practice, the brackets are best positioned so that the elevator tube is behind the basketball pole 4. To mount or remove the net assembly 68 from ground level, the inner elevator tube is rotated so that the net is in the position of FIG. 1B, so that rotation down of the elevator tube does not interfere with the backboard. Further, to adjust the vertical elevation, it is best to extend or retract the inner tube 26 when the elevator assembly is horizontal and there is no net on the brackets 64. The height is adjusted by inserting pin 97 through hole 96 in the outer tube 24, and through a selected one of the holes 98 in inner tube 26, see FIGS. 3A–3C and 4A. The array of vertical adjustment holes may be on the order of 1'–2' in span. It is preferred that the plate 59 rest on the top cap and washer 31/49 of the outer tube, see FIGS. 3C and 3D.

Figure 3:
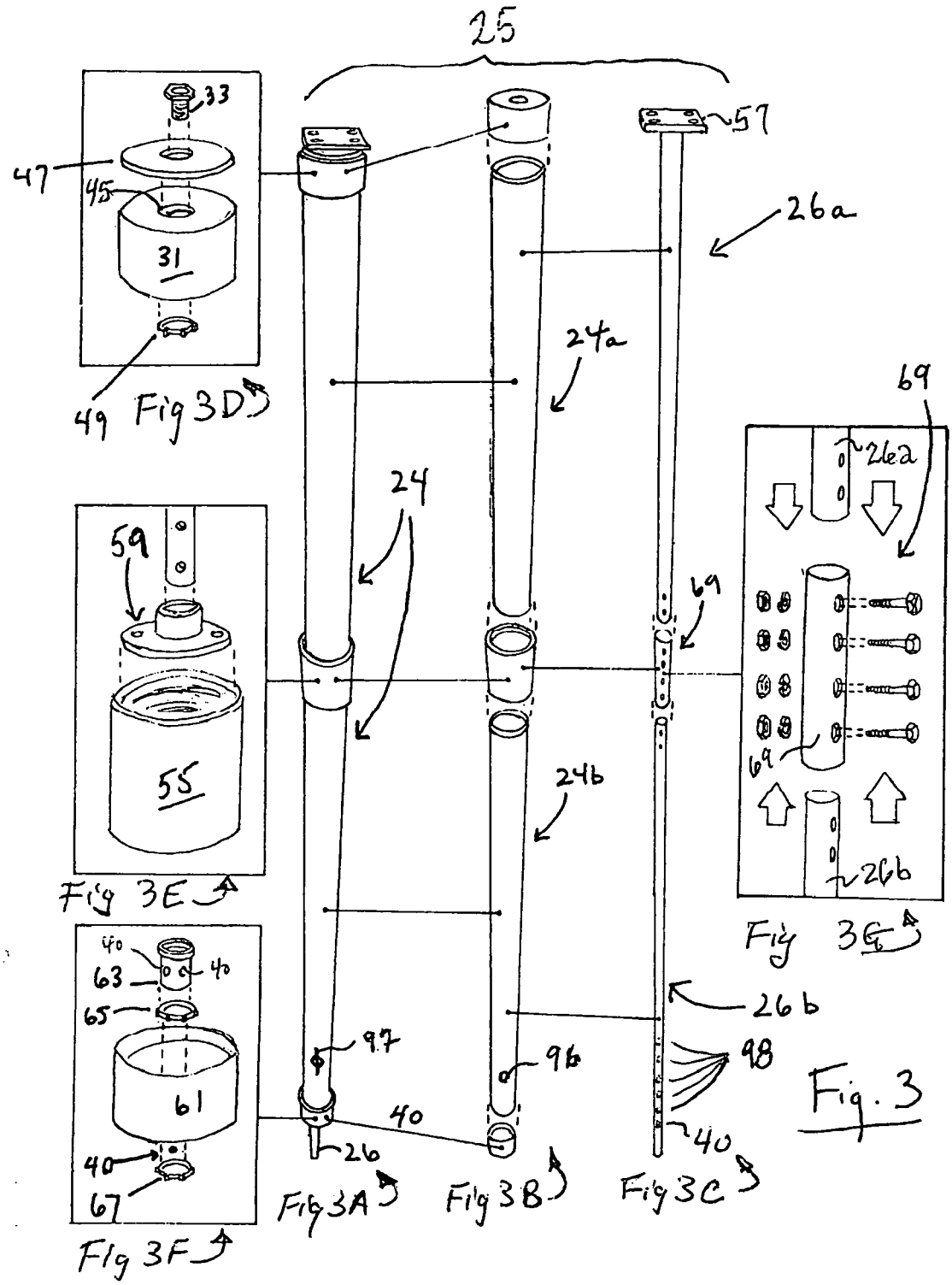

FIG. 3 shows assembled and exploded views of the elevator assembly 25, in which: FIG. 3A shows the assembled elevator assembly 25; FIG. 3B shows the outer tube 24 in two parts; FIG. 3C shows the inner tube 24, also in two parts; FIG. 3D is an exploded, enlarged view showing the upper end cap 31 and washer 47; FIG. 3E is an exploded, enlarged view showing the threaded connector 55 for the upper and lower parts of the outer tube 24; FIG. 3F shows the bottom cap 61 with inner tube bushing 63 and lock nuts 65, 67; and FIG. 3G shows the connector 69 for joining the two parts 26*a*, 26*b* of the inner elevator tube. Together these comprise the components of the vertical elevator assembly 25. When assembled, FIG. 3A, vertical elevator assembly 25 comprises the hollow outer tube 24 which receives the inner adjustable elevator pole or tube 26.

The adjustable elevator pole 26 is slidably vertically adjustable within the outer tube 24 and is secured in position by pin 97 (see FIG. 4A) inserted through aligned holes 96, 98 in the outer tube 26 and inner tube 24 (see also FIGS. 3A–3C). For rotational adjustment, as seen in FIG. 4*a*, pin 42 is inserted through hole 40 in bushing 63 and thence through hole 40 in inner tube 24; the pin 42 is retained by a cotter pin 43. FIG. 4D shows the opposite side of FIG. 4A with the cotter pin keeper 43 inserted in the pin 42. Note the plurality of holes 40 in bushing 63 set at 30°–90° with respect to each other. Once the inner pole 26 is rotated, say to bring the net to one side and at the height desired, the holes 40 in the pole end, seen in FIG. 3C, are aligned with the holes in bushing 63, the pin 42 inserted to lock the net in position, and the keeper cotter pin 43 is inserted to prevent the pin from falling out. While the use of two pins 42 and 97 are described, it should be understood that it is preferred to simply use a single pin 42 with the array of holes 40 and 98 in inner elevator tube 24 in combination with the multiple holes in bushing 63. Once the height is determined with reference to holes 98, the angular adjustment is made by selecting the proper hole in bushing 63, and the pin 42 inserted through it into either hole 40 or 98 of inner tube 24 sets both the height and angle. Height can also be adjusted by raising or lowering the bracket 20 on pole 4.

Referring to FIGS. 3A–3D, parts 33 (upper bushing), 47 (upper washer), 31 (upper PVC end cap having predrilled hole 45), 49 (upper lock nut) and 24*a* (upper elevator outer tube) have all been pre-screwed and/or pre-glued together, making up one complete section of the top elevator outer tube 24*a*. All PVC plastic pipe and fittings are selected to be very rigid, such as schedule 40 grey, electrical 2½" or 3" diameter PVC tubing for suitable strength. Then the upper half 26*a* of adjustable elevator pole 26 is inserted through the assembled upper bushing/end cap assembly as mounted on outer tube 24*a*, FIGS. B-3D, until it extends out through the bottom of the top section of outer tube 24*a*.

The lower adjustable elevator tube 26*b* is inserted through the inside metal spacer 59, middle PVC coupling 55 (see FIG. 3E), lower PVC elevator outer tube 24*b*, the lower end cap bushing 63, lower lock nut 65 on lower PVC end cap 61 and through end lock nut 67 (see FIG. 3F). Parts 55 (middle PVC coupling), 63 (lower end cap bushing), 65 (lower lock nut), 61 (lower PVC end cap) and 24*b* (lower elevator outer tube) have been pre-glued together, making up one complete section of the lower elevator tube 24*b*.

After upper adjustable elevator pole 26*a* has been inserted into upper elevator outer tube 24*a*, and after lower adjustable elevator pole 26*b* has been inserted into lower elevator outer tube 24*b* and through the connector centering flange/bushing 59, then upper and lower elevator poles 26*a* and 26*b* are bolted together by connector tube 69 as seen in FIGS. 3C and 3G. The inner tube 26 can slide and rotate in the bushings 33, 63 and the centering flange/bushing 59.

The section of upper outer tube 24*a* is then glued (with PVC glue) to lower outer tube 24*b* at middle PVC coupling 55. Thus, only one application of PVC glue is necessary during assembly by the consumer. All other component parts have been pre-glued, and pre-assembled. Optionally, the two sections of the inner adjustable tube or pole 24*a*, 24*b*can be glued at the connector 69.

In an important alternative embodiment suitable for standard shipping containers, the upper elevator outer tube 24*a*, lower elevator outer tube 24*b*, upper adjustable elevator pole 26*a* and lower adjustable elevator pole 26*b* have been divided into four shortened sections to lower shipping costs. Those four parts as well as horizontal extension bar assembly 54 (outer tube 58 and inner bar or tube 60, see FIG. 5), U-bracket bar 62 and galvanized pipe sections 90 of the hanger bar assembly 70 are preferably chosen to be a length of approximately four feet or less in order to fit within the box length requirements for lowest shipping costs. All of these parts can thus be placed into a packaged kit of approximately four feet in length. It should be noted that where shipping is not an issue, full length metal or plastic parts are preferred in place of the multiple shorter part segments, reducing the required assembly.

Although the inventive, universal, vertical and rotationally position-adjustable net-type backstop system has some of its component parts made of PVC plastic tubing in order to lower shipping costs and reduce package weight, it should be noted that metal parts can likewise be substituted for plastic parts.

FIG. 4A is an isometric view from a slightly lower perspective of the bracket assemblies 18, 20, 22 that support the outrigger assembly 10 and connect it to the support pole 4. The lower portion of the overall outrigger assembly is shown, comprising an elevator tubing sub-assembly 25, which is mounted to a support pole 4 by upper bracket assembly 20 and lower bracket assembly 22. The elevator tubing assembly 25 comprises an outer tube 24 and an inner, adjuster elevator pole 26; the parts and functioning of this assembly 25 was described above with reference to FIG. 3.

Upper bracket 20 includes a horizontal pivot assembly shown in detail in FIG. 4B, which shows the bracket half holding the outrigger tube 24*a* turned 90° (horizontal) with respect to the bracket half secured to the support pole 4, as shown by Arrow A. Referring to FIGS. 4A and 4B, the upper bracket assembly 20 comprises a pair of brackets 30*a*, 30*b*, each of which constitute half the bracket, formed from a metal angle section 30*a* to which is welded a notched metal U-channel member 30*b*. The metal may be mild or stainless steel or aluminum. The notch is sized to conform to the angle bracket; they are fitted together and welded. A flat endplate 30*c* is welded to the outer, free end of each U section 30*b* and a hole is drilled in the end plate for the pivot bolt 28 (see enlarged drawing section below FIG. 4B). The use of U members permits the bottom of the stand-off section 30*b* to be open at the bottom for access to insert and tighten the pivot assembly 46 (FIG. 4B). Note the angle section 30*a* for the pole 4 is larger than the angle 30*a* for the elevator outer tube 24*a*; all parts of the brackets can be made of tough plastic or composites.

Each bracket angle member 30*a* is secured in position to the respective poles 4 or 26*a* by a pair of spaced clamps 32 centered in notches 86, which prevent the clamps 32 from sliding off the angle member and permit the clamps to be wrapped closely against the round basketball pole 4 and elevator outer tube 24 for a tighter grip. The clamps 32 are sufficiently flexible to take the shape of the basketball pole 4 when tightened, whether the pole 4 is round or square. In addition, the use of angle brackets is preferred as the angle can fit either a round or square support pole, the latter at a corner. Indeed an angle fits an octagonal pole or one out of round or not truly square. In the alternative to an angle, the bracket can use a shallow channel member.

Referring to FIG. 4A, the circled enlarged view shows a band-type clamp 32. A suitable type is a cinch type band having diagonal transverse slits engaged by a worm screw for tightening by a screwdriver. Foam pads 34 at the margins of the angle member 30*a* are compressed by the clamps 32 and provide a better grip on the pole surface when the clamps 32 are tightened around the basketball pole 4 and elevator outer tube 24.

Figure 4C:
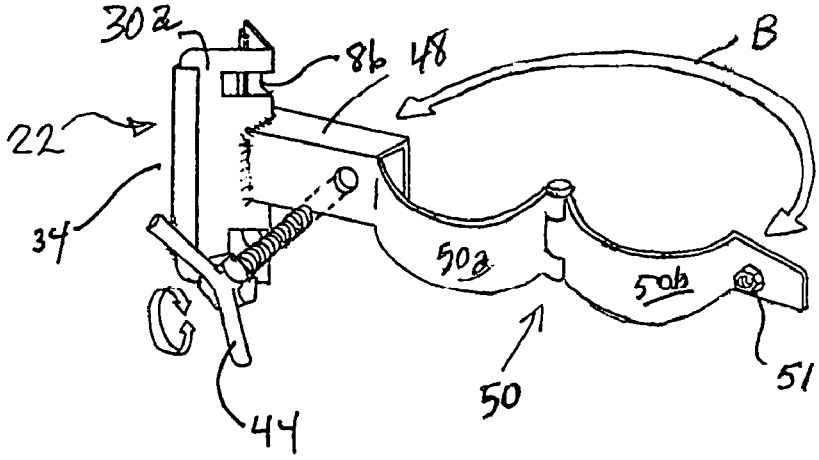
FIG. 4C shows the lower, locking bracket in an open, unlocked position.

Referring to FIG. 4A, lower bracket assembly 22 includes a notched tube 48 welded to an angle section 30*a*. A fixed half 50*a* of hinged locking clamp 50 (shown in an unlocked position in FIG. 4A) is welded to the outer end of the tube section 48. When the outer elevator tube is in the vertical position, the hinged clamp half 50*b* is closed as shown by Arrow B, and the threaded winged bolt 44 engages the nut 51, which is preferably welded to the clamp section 50*b*. FIG. 4C shows the clamp fully open, and FIG. 4A shows the clamp just being opened. A keeper nut may be provided midway down the length of the shank of bolt 44 to prevent the bolt from becoming lost. An optional, additional foam pad 35 may be wrapped around the pole 4 for the clamps 32 to squeeze when tightened, thereby providing a tighter frictional grip between the upper and/or lower brackets 20, 22 and basketball pole 4.

Just below FIG. 4B is an exploded and somewhat enlarged view of the upper bracket assembly pivot 46. As shown in FIG. 4B, the upper bracket assembly halves are pivotally joined by bolt 28 and washers 39. Shown are three nylon washers 39 and two metal washers 38. The metal washers 38 may be omitted where a flanged bolt and nut are used. In cross section, the pivot extension sections 30*b* are U-shaped with facing end plates 30*c* to receive the pivot bolt 28. A lock nut, flanged nut with grooved lower surface, or nut plus lockwasher 51 secures the pivot bolt that holds upper bracket assembly halves together.

FIG. 4C shows a close-up rear view of the lower bracket assembly 22. As shown in FIG. 4C, the hinged locking clamp 50 comprises two semi-circular hinged clamp sections 50*a* (fixed) and 50*b* (movable), designed to wrap around the elevator outer tube 24 of the vertical extension bar assembly 18. The hinged locking clamp 50 is secured in a locked position by winged bolt 44.

Referring back to FIG. 4A, the outrigger assembly 10 may be pivoted on a vertical axis by: (1) opening the hinged locking clamp 50 of the lower bracket assembly 22 by unscrewing the winged bolt 44; and, (2) swiveling the vertical elevator bar assembly 25 on pivot 46 that joins the two halves of the upper bracket assembly 20. As more fully described above, this pivoting allows a user of the net backstop system to lower the U-bracket bar essentially to access from ground level for mounting and removal of the net assembly 68.

FIG. 4A also shows an optional but preferred counterbalance assembly 18 comprising return spring 36 connected between an angle member 37 secured to pole 4 by clamps 32, and an angle 37 secured by clamps to the elevator outer tube 24. This return spring 36 creates tension between the outrigger assembly 10 and the support pole 4 during the pivot motion lowering the U-bracket bar 62. This provides a force to return the outrigger 10 to its original, upright position from a horizontal position. The spring angle holders 37 are preferably interchangeable, and comprise an angle equivalent in size to the angle 30*a* for the outrigger, but which includes an eye welded or threaded to the angle at its apex midway between the clamp notches 86. The inventive system 2 is highly adjustable, in that by changing the vertical distance between the two spring brackets 37 the return force can be varied and controlled. Spacing them farther apart provides a greater return force. This counterbalance assembly 18 does not to interfere with existing basketball backboard height adjusters, such as the parallelogram-type backboard adjuster 94 (shown in FIG. 1C).

Figure 5:
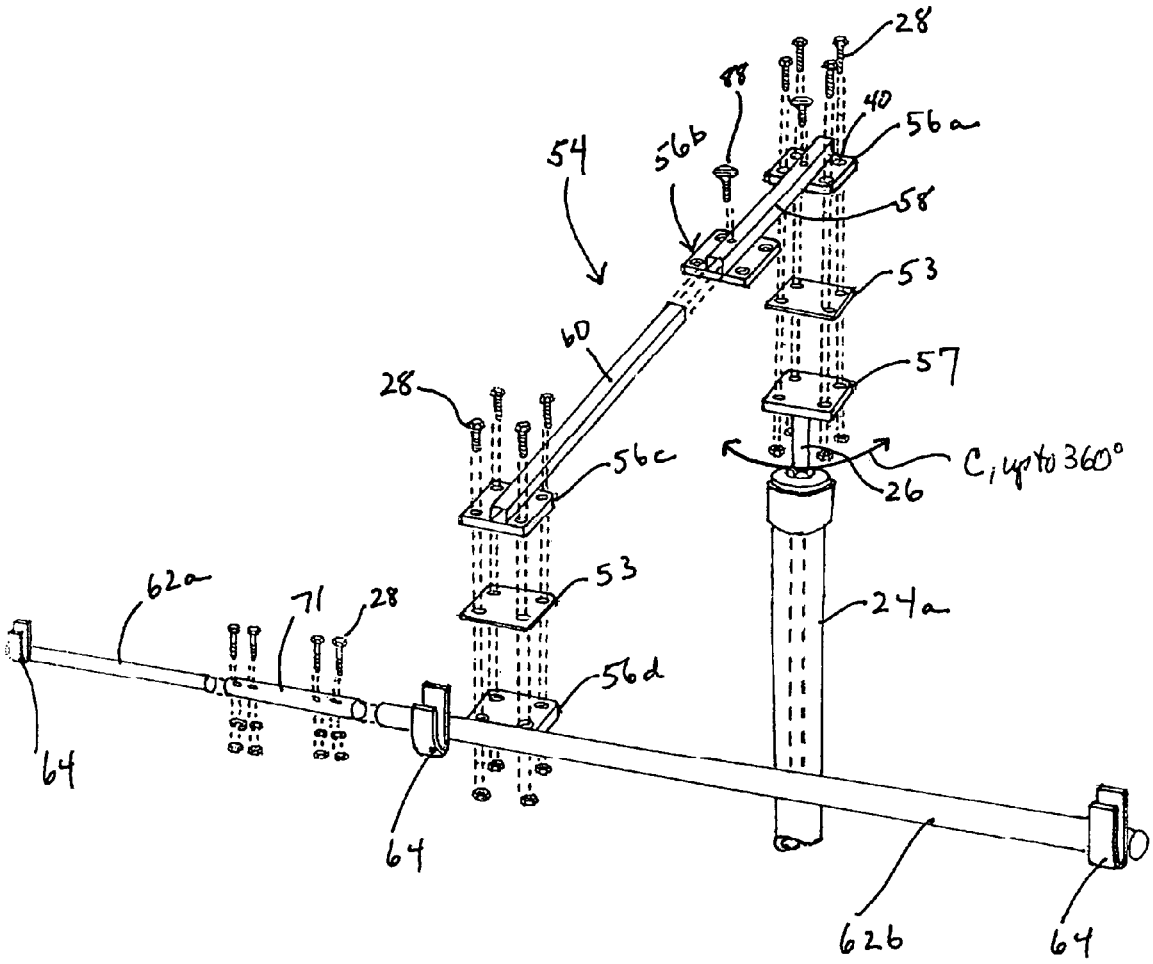
FIG. 5 is an exploded isometric view of the outrigger assembly, including the horizontal, telescoping extension bar and the U-bracket assembly, including exploded representations of the bolts for the connections between the parts.

FIG. 5 is an exploded view of the extension bar assembly 54 that is secured to the top of the inner elevator pole 26. Extension bar assembly 54 comprises a hollow square tube 58 welded, at each end, to square plate 56 having holes for securing bolts 28. The top of pole 26 includes a matching plate 57. Horizontal extension bar or tube 60 is slidably inserted into the extension tube 58 so that it is horizontally, telescopingly extendable. One or more compression bolts or set screws 88 inserted through the square tube 58 of the extension bar assembly 54 may be tightened to hold the horizontal extension bar 60 in the desired extended length position. The right-most plate 56*c* secures the horizontal extension bar 60 to the U-bracket bar assembly 16. The rubber or compressible plastic pads 53 assist in securing the plates 56*a* to 57 and 56*c* to 56*d*. Plate 56*b* is provided with holes so that the extension bar assembly can be secured directly to plate 56*d* of the hanger bar assembly 62 without the telescoping extension bar 60, if the extra extension provided by the bar 60 is not needed.

Also shown in FIG. 5 are exploded views of the connections and attachments between the U-bracket bar assembly 62 and the extension bar assembly 54 via the optional horizontal extension bar 60. Starting at the left, the U-bracket bar 62 is bolted to the horizontal extension bar 60 by four bolts 28 inserted through holes 40 in overlapping square plates 56*d*, 56*c*. Square base plate 56*d* is welded to the U-bracket bar 62; and a top square plate 56*c* is welded to the horizontal extension bar 60. Connector tube 71 holds segments 62*a* and 62*b* of U-bracket bar 62 together by use of nuts and bolts 28. A plurality of spaced U brackets 64 are welded or screwed to the tube 62.

Figure 6:
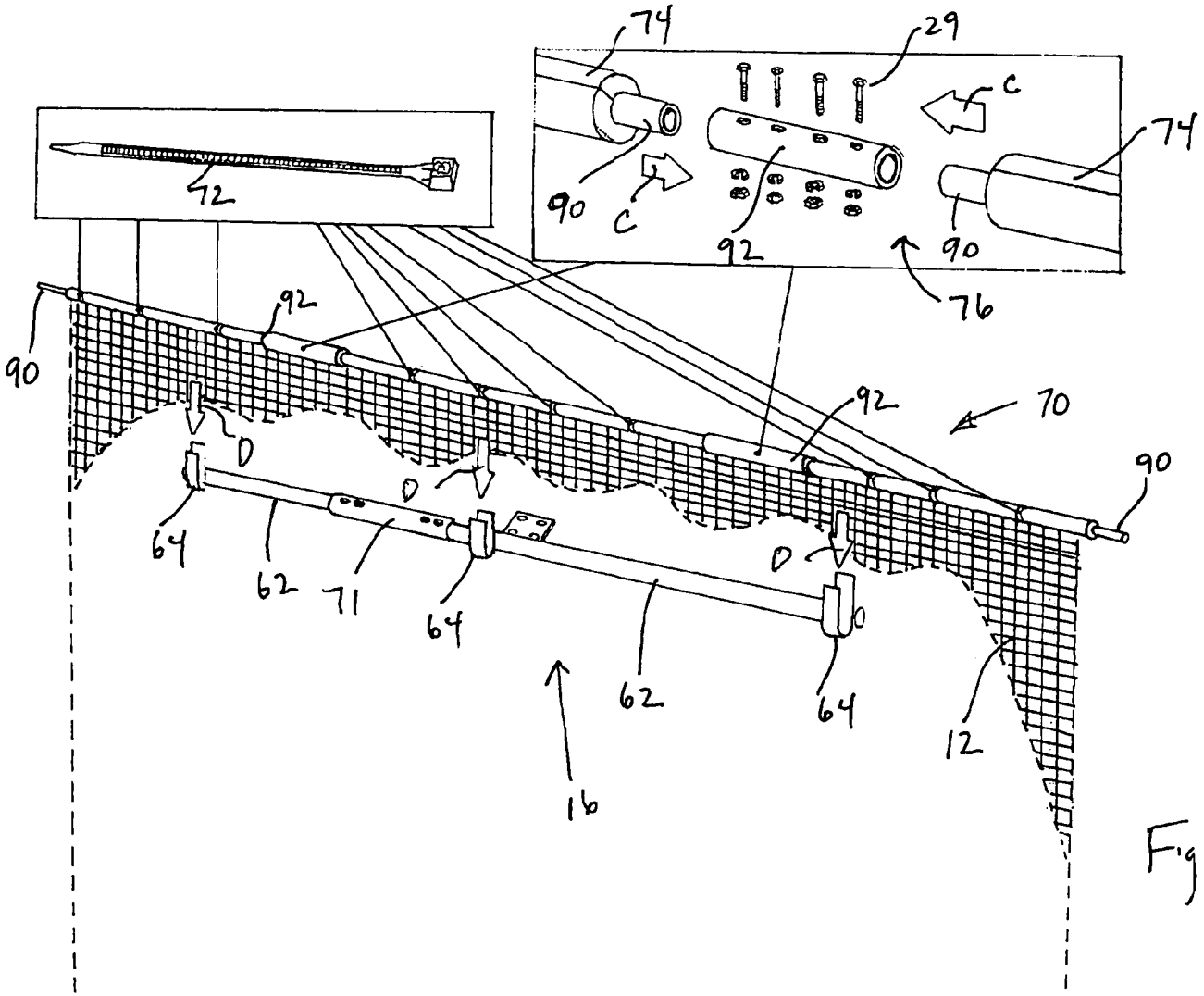
FIG. 6 is an isometric drawing showing a net mounted on the hanger rod, with an exploded view at top right, of a connector for connecting two parts of the hanger rod, and a second exploded view at top left, showing a typical tie used to connect the netting to a net hanger rod.

FIG. 6 is an isometric drawing showing the net assembly 68 which comprises one more net hanger rods 90 attached by connector assembly 76. The net hanger rod 70 shown in FIG. 6 comprises three segments of tubing 90 secured together by tube connector 92 and secured with screws 29. Additional hanger rod sections 90 may be added at either or both ends, as desired, to correspond to the width of the netting 12 used.

In the preferred embodiment, the net hanger rod 70 comprises a light weight, half-inch diameter, galvanized pipe 90 encased in an optional foam sleeve 74. The netting 12 is secured to the net hanger rod 70 by plastic zip ties 72 (shown in detail in the top left exploded view in FIG. 29). The plastic zip ties 72 are inserted through holes in the netting 12 or through grommets provided in the selvage edge of the netting, and fastened around the external foam sleeve 74 or directly around net hanger rod 90.

As shown, the galvanized pipe 90 has been divided into three sections that are joined by two section tubes 92, for lower shipping costs and more efficient packing. Likewise, U-bracket 62 has been divided for the same reason. U-bracket bar segments are joined by a connector tube 98 sized for the U-bracket tubing, but otherwise similar to connector 92.

Continuing to refer to FIG. 6, the connector assembly 76 (shown in detail in the top right exploded view), connects the net hanger rod segments 90. The connector assembly 76 comprises a short connector tube 92 with open ends for sliding over the ends of the internal galvanized pipe 90 extending from within the foam sleeves 74. The connector tube 92 is held in position by the insertion and tightening of set screws 29 through holes in the connector tube 92.

The net hanger rods 70, 70' and attached netting 12 are gravitationally retained by the U-brackets 64 of the U-bracket bar 62. The height and depth of the U-brackets 64 is designed for secure retention of the net hanger rod 70 and netting 12.

Set-up and Operation:

By way of example and not by way of limitation, the following method may be used for initial set up of the inventive backstop net system 2 behind and above the basketball backboard 8 as shown in FIGS. 1A, 1C.

The initial set up comprises the steps of: (1) assembling and raising the outrigger assembly 10 to a vertical position parallel to the basketball pole 4 (lean it against the pole or the backboard); (2) mounting the upper and lower bracket assemblies 20, 22 of the outrigger assembly 10 to the basketball pole 4; (3) fitting the pivot bolt 28 through the two end plates 30*c* of the halves of the upper bracket 20 and tightening the nut 51, then unlocking the hinged locking clamp 50 of the lower bracket assembly 22; (4) pivoting the vertical elevator bar assembly 25 on the horizontal axis of the upper bracket 20 until the extension bar assembly 54 bolted to the top of the vertical elevator assembly 25 has dropped to a height within reach of a user; (5) bolting the U-bracket bar assembly 62 to the extension bar assembly 54 by inserting bolts 28 through holes in overlapped square plates 56*c*, 56*d*; (6) separately preparing the net assembly 68 by: a) connecting two net hanger rods 90; b) tying the netting 12 to the net hanger rods 90 with plastic zip ties 72; (7) lifting and placing the net assembly 68 into the U-brackets 64 of the U-bracket bar assembly 16; (8) pulling downward on the rope 52 tied to the base of the adjustable elevator pole 26 to rotate the vertical elevator bar assembly 25 to an upright position, thereby lifting the net assembly 68; (9) re-locking the hinged locking clamp 50 of the lower bracket assembly 22 around the outer tube 24 to secure the outrigger assembly 10 in an upright position, with net assembly 68 hanging above and behind the backboard 8; and, (10) adjusting the height of the net assembly 68 to the desired position by removing pin 42 at the base of the outer tube 24, sliding the elevator pole 26 upward or downward, as desired, and re-locking the elevator pole 26 in position by re-inserting the pin 42 through the holes in the outer tube 24 and corresponding holes in the elevator pole 26, and inserting the cotter pin as shown in FIG. 4D.

In operation, the net assembly 68, when behind and above the basketball backboard, may be used for basketball practice. Errant basketball shots will hit the netting 12 and fall to the ground, as shown in FIG. 1C.

Referring to FIGS. 4A and 5, if a user desires to practice basketball shots from either side of the basketball hoop 6, the net assembly 68 may be rotated to one or the other side by: (1) removing the pin 42 connecting the adjustable elevator pole 26 to the outer tube 24; (2) manually twisting the base of the adjustable elevator pole 26 (which extends out of the outer tube 24) until the net assembly 68 has been rotated to the desired position; (3) re-inserting pin 42 in alternate position holes 41*a*, 41*b* (FIG. 4A). As shown in FIG. 5, the extension bar assembly 54 is bolted to the top end of the adjustable elevator pole 26. Consequently, by rotating the adjustable elevator pole 26, the extension bar assembly 54 will rotate along with the net assembly 68.

Other sport practice may be accomplished by changing the position, height, and/or width of the net assembly 68. For example, referring to FIGS. 1C, 1D, 2, and 5, the distance between the net assembly 68 and the basketball pole 4 may be increased by use of a horizontal extension bar or tube 60 slidably inserted through the square tube 58 of the extension bar assembly 54.

Referring to FIGS. 1B and 6, the width of the net assembly 68 may be increased by connection of additional net rods 90 and tieing to them the extra width of netting 12. Wider netting 12 would be useful for golf practice, as shown in FIG. 1B. Net assembly 68 can be stored by rolling up netting 12 around hanger rod 70.

INDUSTRIAL APPLICABILITY

It is clear that the inventive universal, position-adjustable backstop net system of this application has wide applicability to numerous sport industries and provides novel ease of assembly, mounting, use and safety features. The inventive system may be mounted to existing basketball poles or other support poles, whether square or round, and of a wide range of sizes. The inventive system provides a netted barrier of varying heights and widths in a multitude of positions relative to the support pole. As a result, the inventive system may be used to block errant shots, and/or catch practice shots from users playing and/or practicing basketball, baseball, soccer, tennis, golf, etc.

In addition, the inventive backstop net system can be easily made of off-the-shelf components, e.g., EMT conduit, square base plates, steel tubes, netting, PVC tubing, bolts and fasteners. Thus, the inventive backstop net system has the clear potential of becoming adopted as the new backstop system at homes, in schools, on playgrounds, in gyms, or anywhere basketball poles are utilized. In addition, the netted backstop system can have a wide range of designs to provide the functionalities disclosed herein. For example, the netting could be shaped differently for optimization with regard to different sports (e.g., concave areas marked as targets to catch served tennis balls). The net can be weighted down with a variety of types of weights. Examples include sand-filled or water-filled plastic bags, bungee cords hooked to ground pegs, metal weights hooked or configured to engage the mesh, and the like. The weights can be positioned to provide any selected amount of tension, or slack, to deaden the ball striking the net, or to angle it for a pre-selected direction and amount of return. Heavy duty netting or wire/chain link mesh can be used for institutional or professional use. The mesh size can be selected for the particular game use, e.g., large mesh for basketball and small for golf. In addition, dual netting can be used, that is, two or more U-bracket bars and net hanger bars having different sized netting on each can be used in tandem and one, or the other, or both, suspended for backstop use. Ribbons can be tied or secured to the mesh to assist in judging height, distance from the player, or wind direction. The pivot bracket 20 and the stop/locking bracket 24 can be swapped in position, that is, the pivot bracket 20 can be the lowermost bracket and the locking bracket 24 the uppermost.

This invention is therefore to be defined as broadly as the prior art will permit, and in view of the specification if need be, including a full range of current and future equivalents thereof.

PARTS LIST

This parts list is provided as an aid to examination and may be cancelled upon allowance.

2 Inventive backstop net system
4 Existing standard basketball pole
6 Existing standard basketball hoop
8 Existing standard basketball backboard
10 Outrigger assembly
12 Netting
14 Weights
16
18 Counterbalance bracket assembly
20 Upper bracket assembly
22 Lower bracket assembly
24a Upper elevator outer tube
24b Lower elevator outer tube
25 Elevator assembly
26a Upper adjustable elevator pole
26b Lower adjustable elevator pole
28 Bolt
29 Set screws
30a Angle member of mounting brackets
30b U-channel section
30c end plate with hole for pivot bolt 46
31 Top PVC end cap
32 Clamp
33 Top bushing
34 Foam pad
35 Foam pad on pole
36 Counterbalance return spring
37 Spring angle holder
38 Washer (optional)
39 Nylon washer
40 Holes
41a, 41b alternate angle holes
42 Pin
43 Cotter pin (keeper for pin 42)
44 Winged bolt
45 Hole in end cap 31
46 Horizontal pivot assembly of bracket 20
47 Top washer (outside)
48 Lower bracket tube
49 Top lock nut
50 Hinged locking clamp -continued

PARTS LIST

This parts list is provided as an aid to examination and may be cancelled upon allowance.

51 Lock nut upper - bracket assembly
52 Rope
54 Horizontal extension assembly
55 Middle PVC coupling
56a–d Square plates
57 Plate at top of pole 26
58 Square tube
59 Inside metal spacer
60 Horizontal extension bar
61 Bottom PVC end cap
62 U-bracket bar
63 Bottom end cap bushing
64 U-bracket
65 Bottom lock nut
66
53 4-hole rubber pad
67 End lock nut
68 Net assembly
69 Connector tube - elevator pole
70, 70' net hanger bar
71 Connector tube - U-bracket bar
96 vertical adjustment tube in outer tube 24
97 Pin for vertical adjustment.
72 Plastic zip ties
73
74 Foam sleeve
76 Connector assembly
78 Person practicing golf
80 basketball
82 Baseball
84 Baseball player
98 vertical adjustment hole in inner tube 26
86 Notch
88 bolts with welded nuts
90 galvanized pipe
92 tube
94 parallelogram-type backboard height adjuster
Arrow A - pivot of outrigger assembly
Arrow B - opening of clamp 32
Arrow C - Rotation arc
Arrow D - Insertion of hanger bar in U bracket

The invention claimed is:

1. A universal net-type backstop system mountable to a vertically oriented support pole for multi-sports and exercise use, comprising in operative combination:

a) a mounting support assembly which includes at least one pole bracket having a horizontal pivot adjustably mountable to said support pole at any preselected vertical distance above ground or floor level;

b) a vertically oriented outrigger assembly secured to said at least one pivotable pole bracket and which includes:

i) an axially pivotable elevator assembly having a top and a bottom end;

ii) a horizontally oriented extension arm assembly one end of which is mounted to said top end of said elevator assembly, and having an outer end; and iii) a hanger bracket assembly attached to said outer end of said extension arm assembly for receivingly supporting a hanger rod;

c) a net assembly including a hanger rod receivable in said hanger rod support bracket; and a net suspendable from said hanger rod to provide a barrier backstop when deployed;

d) said outrigger assembly is pivotable at said support bracket from a vertical position down to be accessible from ground or floor level for safe mounting and removing said net assembly from said hanger bracket so that the user does not have to ascend a ladder to mount, remove or adjust the position of said net; and e) said outrigger is pivotable on its axis to permit positioning said net from in front of said support pole, in back of said support pole, to either side or to any angle intermediate thereof.

2. A universal net-type backstop system as in claim 1 wherein said outrigger mounting support assembly includes a second pole bracket which includes a member for retaining said outrigger in a vertical position.

3. A universal net-type backstop system as in claim 2 wherein said outrigger elevator assembly includes a pair of nested members, an inner one of which is selected from a tube or pole that is rotatably adjustable with respect to an outer tubular member, said outer tube is secured to said pivotable support bracket and said extension arm assembly is secured to the top of said inner tube.

4. A universal net-type backstop system as in claim 3 wherein said hanger bracket assembly includes U-brackets for receiving said hanger rod.

5. A universal net-type backstop system as in claim 2 which includes a counterbalance assembly linking said pole to said elevator assembly to assist in raising said elevator assembly from a generally lowered position to the vertical, use position.

6. A universal net-type backstop system as in claim 5 wherein said counterbalance assembly includes a pole bracket and a bracket secured to said outer elevator assembly outer tube, and said counterbalance brackets are joined by an extension spring.

7. A universal net-type backstop system as in claim 6 wherein said pole and elevator tube brackets include notches for receivingly engaging clamping bands that can be tightened around said pole and said tube, respectively.

8. A universal net-type backstop system as in claim 3 wherein said elevator assembly inner tube is vertically adjustable with respect to said outer tube.

9. A universal net-type backstop system as in claim 3 wherein said elevator assembly includes a pin to engage holes in at least one of said tubes to provide an array of stop positions at predetermined angular orientations of said net assembly with respect to said support pole.

10. A universal net-type backstop system as in claim 9 wherein said elevator assembly inner tube includes a plurality of holes to permit height adjustment by engagement of a pin in said inner tube holes.

11. A universal net-type backstop system as in claim 3 wherein said elevator assembly includes a pull member secured adjacent a lower end thereof to assist in returning said outrigger from a generally lowered position to an upright vertical position.

12. A universal net-type backstop system as in claim 3 wherein said net assembly includes weight providing members to assist in stabilizing the net.

13. A universal net-type backstop system as in claim 1 wherein said outrigger assembly parts do not exceed four feet in length, and include connector elements to connect the respective parts to their full operational length, to permit shipment of said system in standard-length containers.

14. A universal net-type backstop system as in claim 1 provided as a kit for user assembly.

15. A universal net-type backstop system as in claim 13 provided as a kit for user assembly.

16. A universal net-type backstop system as in claim 1 wherein said extension arm assembly includes telescoping tube members to permit horizontal adjustment of the distance of the hanger bracket from the top of said elevator assembly.

* * * * *